US010690291B1

(12) United States Patent
Shih

(10) Patent No.: US 10,690,291 B1
(45) Date of Patent: Jun. 23, 2020

(54) LED BULB

(71) Applicant: Jen-Chieh Shih, Changhua (TW)

(72) Inventor: Jen-Chieh Shih, Changhua (TW)

( * ) Notice: Subject to any disclaimer, the term of this patent is extended or adjusted under 35 U.S.C. 154(b) by 0 days.

(21) Appl. No.: 16/411,157

(22) Filed: May 14, 2019

(51) Int. Cl.
*F21K 9/232* (2016.01)
*F21K 9/238* (2016.01)
*F21V 29/71* (2015.01)
*F21Y 115/10* (2016.01)

(52) U.S. Cl.
CPC ..... *F21K 9/232* (2016.08); *F21K 9/238* (2016.08); *F21V 29/713* (2015.01); *F21Y 2115/10* (2016.08)

(58) Field of Classification Search
CPC ..... F21V 29/75; F21V 29/777; F21V 29/83; F21V 23/006; F21V 29/506; F21V 29/70; F21K 9/135; F21K 9/232; F21K 9/238; F21K 9/23; F21Y 2101/02; F21Y 2115/10
See application file for complete search history.

(56) References Cited

U.S. PATENT DOCUMENTS

2011/0273072 A1* 11/2011 Oki ..... F21V 29/004 313/46
2013/0235586 A1* 9/2013 Gielen ..... F21V 3/02 362/294
2013/0335966 A1* 12/2013 Yokota ..... F21V 3/02 362/235
2014/0247606 A1* 9/2014 Chen ..... F21V 29/004 362/363
2015/0192254 A1* 7/2015 Moon ..... F21V 29/508 362/650
2015/0285471 A1* 10/2015 Shih ..... F21K 9/20 362/249.01
2016/0223180 A1* 8/2016 Jiang ..... F21K 9/232
2019/0003659 A1* 1/2019 Miyajima ..... F21K 9/27
2019/0346084 A1* 11/2019 Steele ..... F21V 9/30

* cited by examiner

*Primary Examiner* — Britt D Hanley
*Assistant Examiner* — Fatima N Farokhrooz
(74) *Attorney, Agent, or Firm* — Leong C. Lei

(57) ABSTRACT

A LED bulb comprises: a lamp-seat capable of connecting an external power supply, a lampshade fixed above the lamp-seat, and a circuit board mounted in the lamp-seat and the lampshade. The bottom end of the circuit board is electrically connected to the lamp-seat, and the top end defines a first portion provided for setting the upper-emitting light-source module. The circuit board has a second portion with a width gradually downwardly widened, and the second portion is set with an oblique-upper emitting light-source module. The circuit board is connected to a third portion, and the third portion has a width gradually narrowed downwardly, and the third portion is set with an oblique-lower emitting light-source module. The light-source modules are composed of a plurality of LED arrays and are suspended inside the lampshade, so they are compatible with the specification requirements of the United Nations Economic Commission for Europe's automotive Regulations.

15 Claims, 7 Drawing Sheets

LED BULB

(a) TECHNICAL FIELD OF THE INVENTION

The present invention provides an LED bulb that is compatible with the United Nations Economic Commission for Europe's automotive Regulations.

(b) DESCRIPTION OF THE PRIOR ART

The prior art is as disclosed in the invention patent "FULL-BEAM-ANGLE LED BULB STRUCTURE" of Taiwan patent application number 102131605, or as shown in the Taiwan patent "LIGHT-EMITTING DIODE LIGHTING FIXTURE" of Taiwan patent application number 096213437.

However, these prior art techniques are not compatible with the current studying and discussing specifications of the United Nations Economic Commission for Europe's automotive regulations for light-emitting diode (LED) alternative light source PY21 W/LED, which are at least incompatible with the following two specifications:

1. The array LEDs are not compatible with the 9 mm×7 mm×5 mm layout specifications.
2. The illumination angle of the array LEDs does not meet the 300° requirement.

In view of this, the inventor of the present invention has developed and invented the present invention through continuous conceiving and research.

SUMMARY OF THE INVENTION

The main contents of the present invention at least comprises: a lamp-seat capable of connecting an external power supply, a lampshade fixed and set above the lamp-seat, and a circuit board mounted in the lamp-seat and the lampshade; wherein the bottom end of the circuit board is electrically connected to the lamp-seat, and the top end of the circuit board defines a first portion, wherein the outer surface of the first portion is set with a plurality of LEDs in array for forming an upper-emitting light-source module; wherein the circuit board has a second portion with a width which gradually downwardly widens on both sides of the first portion, and the width refers to the distance between the left side and the right side of the circuit board; wherein the outer surface of the second portion is set with a plurality of LEDs in array for forming an oblique-upper emitting light-source module; wherein the circuit board is connected to a third portion at the bottom end of the second portion, and the third portion has a width which gradually narrows downwardly to maintain a set height between the bottom end of the third portion and the bottom end of the circuit board; wherein the outer surface of the third portion is set with a plurality of LEDs in array for forming an oblique-lower emitting light-source module.

It can be known that the relative arrangement of the above-mentioned upper-emitting light-source module, oblique-upper emitting light-source module, and oblique-lower emitting light-source module can be easily compatible with the requirements of the United Nations Economic Commission for Europe's automotive regulations on the array LED layout and the illumination angle requirements. Therefore, the present invention has the progressiveness of being available for the industrial use.

DETAILED DESCRIPTION OF THE PREFERRED EMBODIMENTS

Figure 1:
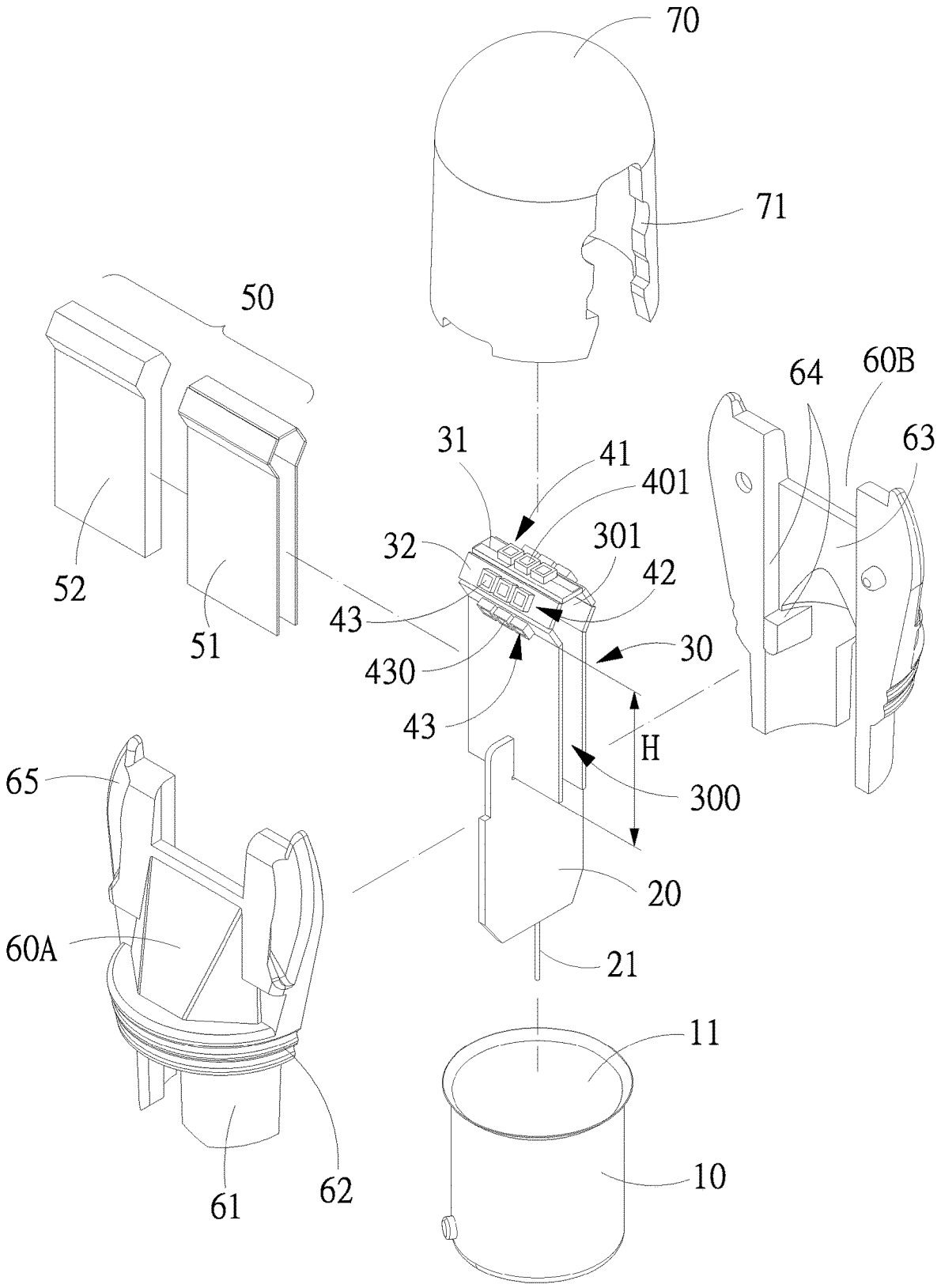
FIG. 1 is a decomposition schematic diagram of the present invention.
Figure 2:
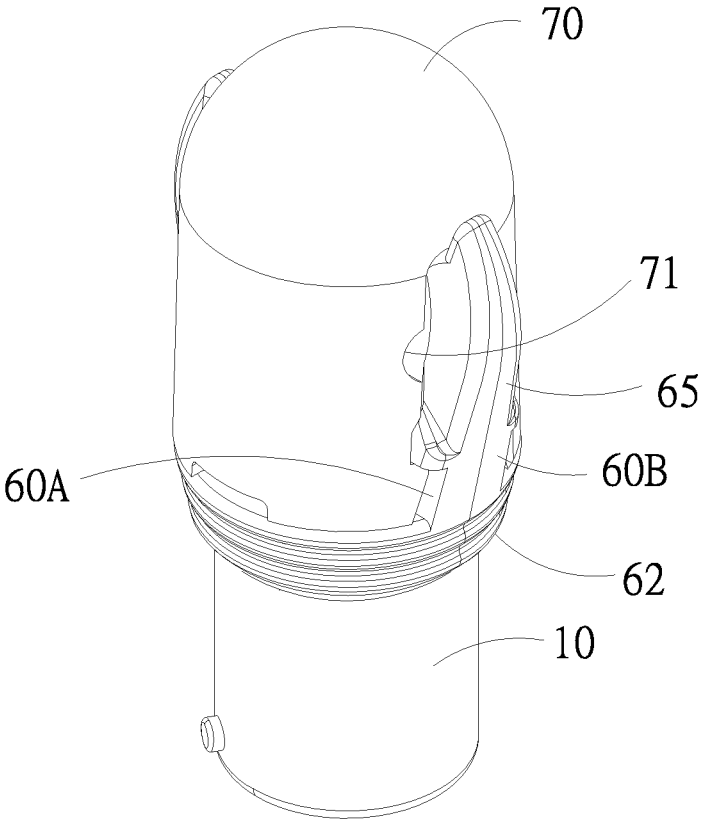
FIG. 2 is a combined appearance schematic diagram of the present invention.
Figure 3:
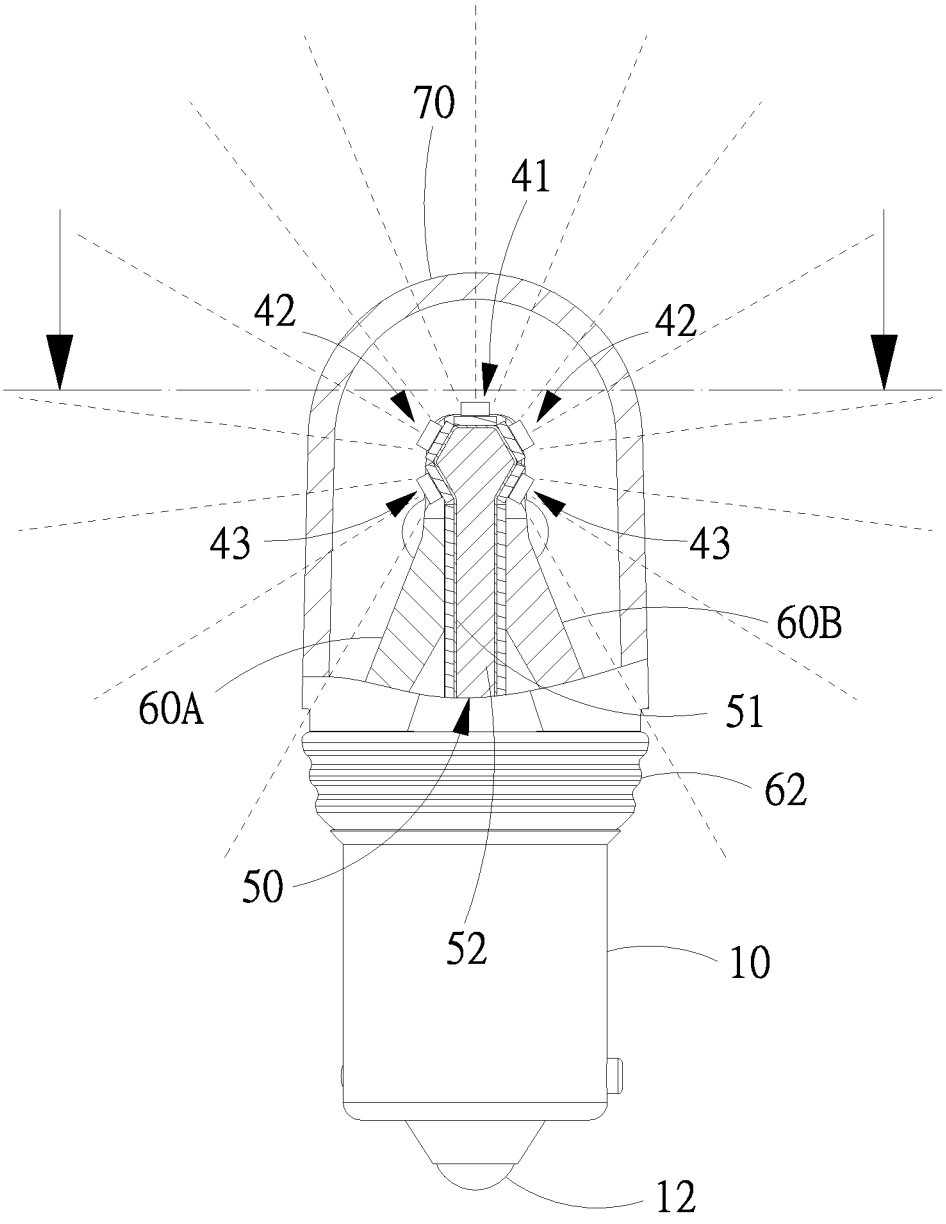
FIG. 3 is a longitudinal partial combined sectional schematic diagram of the present invention.

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Please refer to FIG. 1 to FIG. 7, the present invention comprises at least: a lamp-seat 10 defined with an accommodating-room 11 having an opening facing upward, wherein a connector 12 capable of connecting an external power supply is set at the bottom of the lamp-seat 10, and the connector 12 can be adopted in accordance with international 1157, 3157, T20 or other standardized specifications, so that it can be assembled in a lighting equipment; a driving circuit 20 mounted in the accommodating-room 11 and having an electrode pin 21 electrically connected with the connector 12, wherein the driving circuit 20 mainly controls the input current from the connector 12 to provide the need of a circuit board 30 being described later; a circuit board 30 that forms a casketing-room 300 with an opening facing downward, and further defines that the front and rear directions of the casketing-room 300 are in a through arrangement, the casketing-room 300 has an open bottom end and a closed top end; wherein the middle portion of the bottom end of the circuit board 30 is electrically connected with the connector 12 of the lamp-seat 10 through the coupling of the driving circuit 20; wherein the top end of the circuit board 30 defines a first portion 31 in a horizontal plane, and a second portion 32 having a width W which gradually downwardly widens is joined to the left and right sides of the first portion 31; and further connected to the bottom end of the second portion 32 is a third portion 33 having a width W which gradually narrows downwardly; so it controls to hold a set height H between the bottom end of the third portion 33 and the bottom end of the circuit board 30; wherein the width W refers to the distance between the left side and the right side of the circuit board 30, so that the first portion 31, the second portion 32, and the third portion 33 are symmetrically formed five sides of a regular hexagon as shown in the figure; also, the casketing-room 300 is relatively formed with a orthogonal-six-angle-hole area 301 penetrating through the front and rear direction within the range of the five sides; an upper-emitting light-source module 41 is formed by setting a plurality of LEDs 410 on the outer surface in array of the first portion 31; an oblique-upper emitting light-source module 42 is formed by setting a plurality of LEDs 420 on the outer surface in array of the second portion 32; an oblique-lower emitting light-source module 43 formed by setting a plurality of LEDs 430 on the outer surface in array of the third portion 33.

Figure 4:
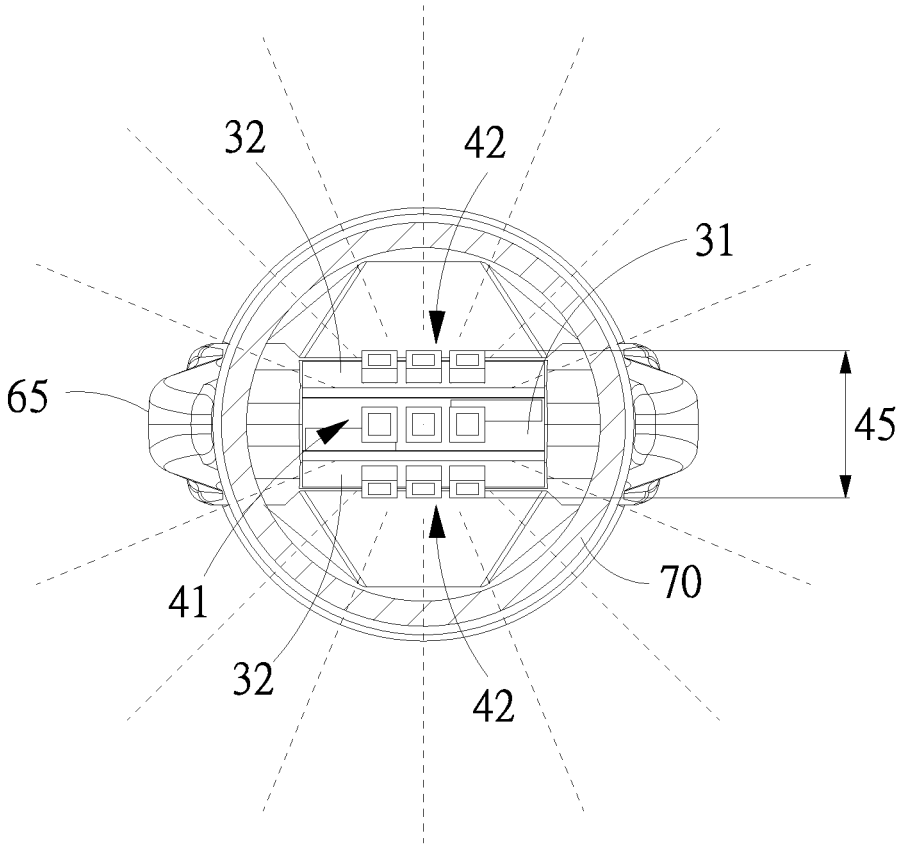
FIG. 4 is a lateral partial combined sectional schematic diagram of the present invention.
Figure 5:
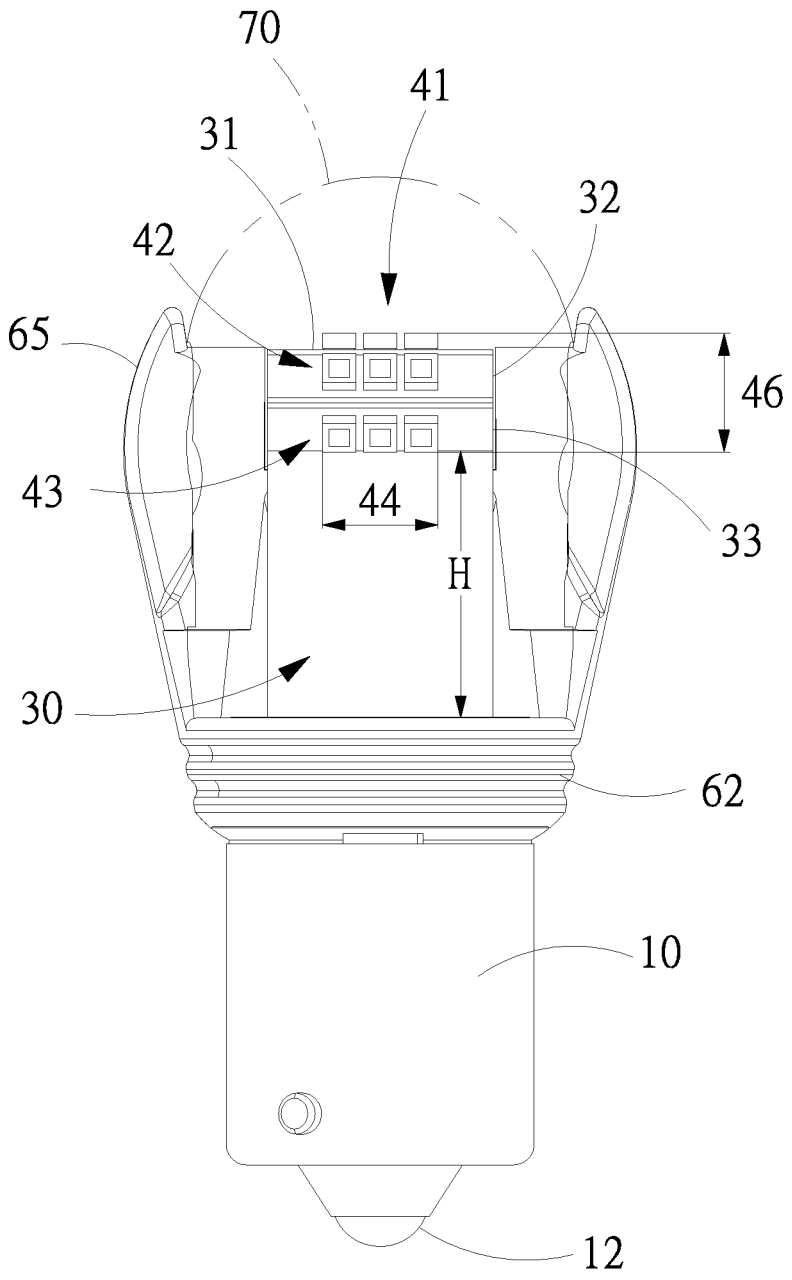
FIG. 5 is an implementation schematic diagram of the array LED layout specifications of the present invention.
Figure 6:
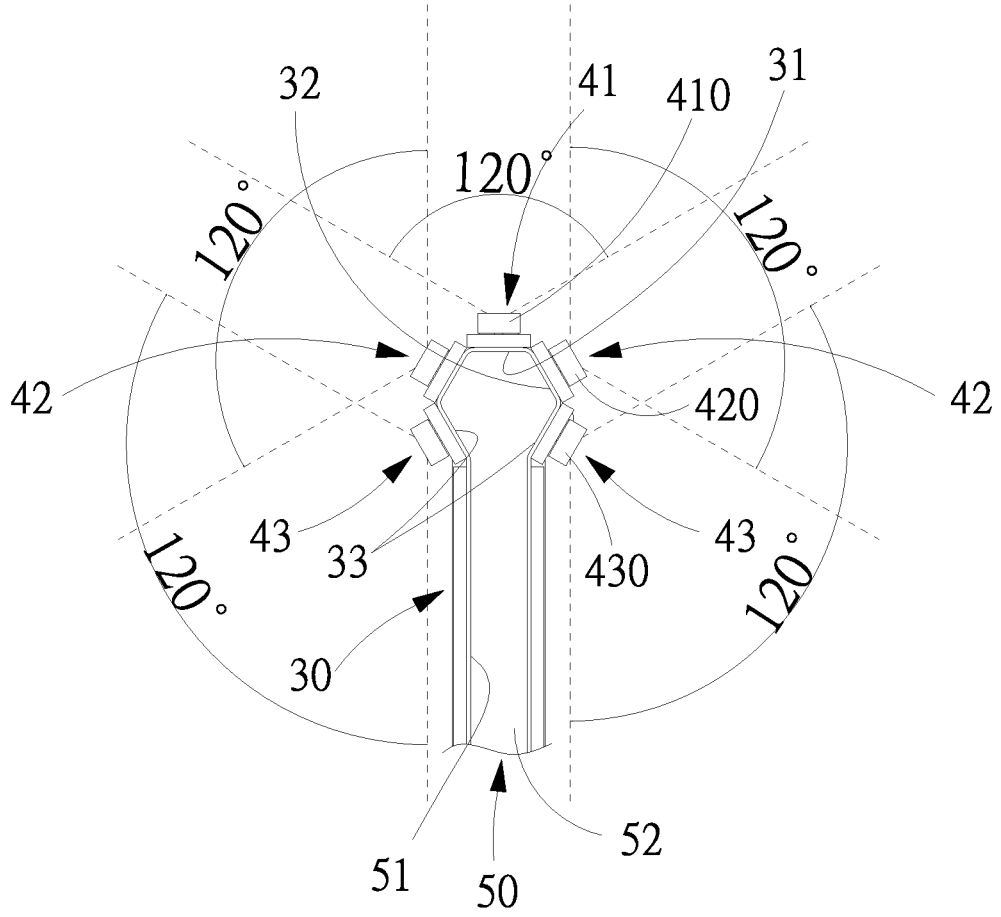
FIG. 6 is an implementation schematic diagram of the of the illumination angle of the present invention.
Figure 7:
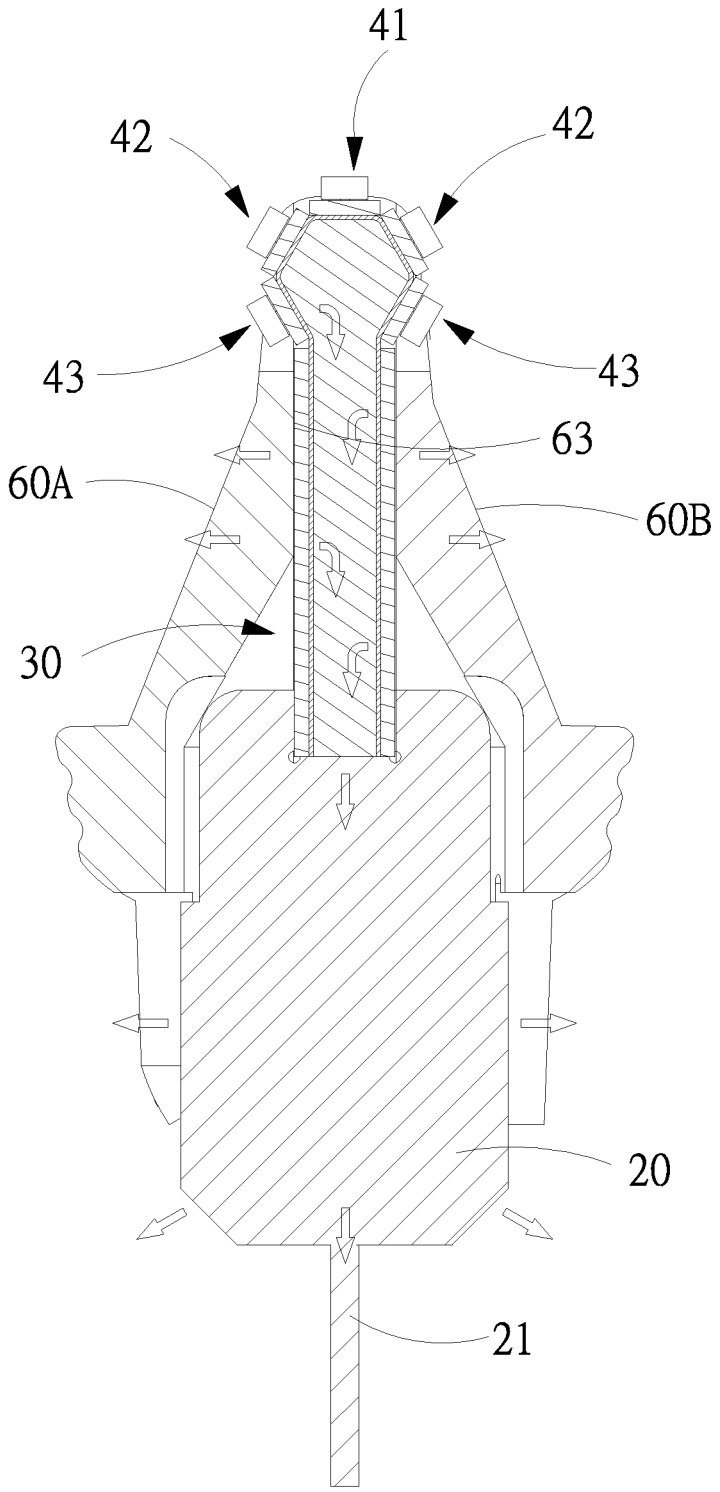
FIG. 7 is an implementation schematic diagram of heat dissipation of the present invention.

Please cooperatedly refer to FIG. 4 and FIG. 5; the present invention controls the front and rear sides of the upper-emitting light-source module 41, the oblique-upper emitting light-source module 42, and the oblique-lower emitting light-source module 43 to be aligned with each other, and the distance is maintained at a first size 44 of 9 mm; further, the distance from the right side to the right side of the upper upper-emitting light-source module 41, the oblique-upper emitting light-source module 42 and the oblique-lower emitting light-source module 43 are controlled to be 5 mm of a second size 45; and the distance from the top end to the bottom end is maintained at 7 mm of a third size 46; therefore, the specification which the first size 44 multiplies the second size 45 multiplies the third size 46 can be easily compatible with the requirement of the United Nations Economic Commission for Europe's automotive regulations for the array LED layout. Furthermore, please cooperatedly refer to FIG. 6, the present invention integratedly cooperates with the upper-emitting light-source module 41, the oblique-upper emitting light-source module 42, and the oblique-lower emitting light-source module 43 through the circuit board 30; so that the upper-emitting light-source module 41, the oblique-upper emitting light-source module 42, and the oblique-lower emitting light-source module 43 each has an illumination angle of 120°; and further controlling the upper-emitting light-source module 41 and the oblique-upper emitting light-source module 42 to have an interlaced angle of not more than 30°, and controlling the oblique-upper emitting light-source module 42 and the oblique-lower emitting light-source module 43 to have an interlaced angle of not more than 30°, thereby enabling the present invention easy to reach the 300° illumination angle, which is compatible with the specification of the United Nations Economic Commission for Europe's automotive regulation for lighting illumination angle; a heat-conducting unit 50 set with a heat-conducting pad 51 symmetrically along the wall surface of the casketing-room 300; and a heat-conducting aluminum-extruding-piece 51 is filled and full in the range of the heat-conducting pad 51; so that the heat-conducting unit 50 can conduct the heat dissipation of the circuit board 30; a heat-dissipating unit formed by combining two heat-sinking pieces 60A, 60B for defining a base portion 61 capable of inserting the accommodating-room 11 and a ring protruding-flange 62 capable of abutting the top end of the lamp-seat 10; and for defining a first region 63 capable of abutting the circuit board 30 to set the height H, a second region 64 capable of abutting the front and rear sides and the bottom end of the heat-conducting unit 50, and a plurality of heat-exchanging blocks 65 which is symmetrically protruded from the front and rear sides over the lamp-seat 10; therefore, the present invention can increase the heat dissipation efficiency of the circuit board 30 by the multiplying effect of the heat-conducting unit 50 and the two heat-sinking pieces 60A and 60B as shown in FIG. 7; and a light-transmissive lampshade 70, which opening faces downward to cover and set the circuit board 30, the upper-emitting light-source module 41, the oblique-upper emitting light-source module 42, and the oblique-lower emitting light-source module 43 in inside; wherein the bottom end of the lampshade 70 is one-body fixed over the lamp-seat 10 through the ring protruding-flange 62 of the heat dissipation unit integrally; wherein the lampshade 70 also has a plurality of notches 71 provided for the heat-exchanging blocks 65 to protrude from the exposed portion; so that the heat-exchanging blocks 65 and the ring protruding-flange 62 can be in contact with the outside air for the heat dissipation of convection.

According to the above structural explanation, the present invention has at least the following features:

1. The overall arrangement which circuit board of the present invention can be easily compatible with the United Nations Economic Commission for Europe's automotive regulations through which the first portion is mounted with the upper-emitting light-source module, the second portion is mounted with the oblique-upper emitting light-source module, and the third portion is mounted with the oblique-lower emitting light-source module; that is, the present invention can be easily compatible with the layout specification requirement of the United Nations Economic Commission's Automotive Regulations on the replacement light-source of the light-emitting diodes (LEDs) for the PY21 W/LED 9 mm×7 mm×5 mm array LED.
2. Continuing to the first point, the present invention controls the upper-emitting light-source module and the oblique-upper emitting light-source module to have an interlaced angle of not more than 30°, and controls the oblique-upper emitting light-source module and the oblique-lower emitting light-source module to have an interlaced angle of not more than 30°; thereby enabling the present invention easy to compatible with the illumination angle specification requirement of the United Nations Economic Commission's Automotive Regulations on the replacement light-source of the light-emitting diodes (LEDs) for the PY21 W/LED.
3. The present invention adopts a casketing-room of a circuit board for sandwiching a heat-conducting unit, thereby increasing the surface area ratio of the heat conduction of the circuit board, and then cooperating the ring protruding-flange of the heat dissipation unit and the exposed heat-exchanging blocks to proceed thermal convection with external air; thereby rapidly moving out the heat of the heat-conducting unit and the circuit board; so the present invention is sufficient for the heat dissipation requirements required for the operation of the upper-emitting light-source module, the oblique-upper emitting light-source module, and the oblique-lower emitting light-source module.

I claim:

1. A LED bulb, which at least comprises:

a lamp-seat capable of connecting an external power supply;

a lampshade fixed and set above the lamp-seat, and a circuit board mounted in the lamp-seat and the lampshade;

wherein the bottom end of the circuit board is electrically connected to the lamp-seat, and the top end of the circuit board defines a first portion, wherein the outer surface of the first portion is set with a plurality of LEDs in array for forming an upper-emitting light-source module;

wherein the circuit board has a second portion with a width which gradually downwardly widens on both sides of the first portion, and the width refers to the distance between the left side and the right side of the circuit board; wherein the outer surface of the second portion is set with a plurality of LEDs in array for forming an oblique-upper emitting light-source module;

wherein the circuit board is connected to a third portion at the bottom end of the second portion, and the third portion has a width which gradually narrows downwardly to maintain a set height between the bottom end of the third portion and the bottom end of the circuit board;

wherein the outer surface of the third portion is set with a plurality of LEDs in array for forming an oblique-lower emitting light-source module;

wherein the circuit board defines a casketing-room with an opening facing downward, and further defines that the front and rear directions of the casketing-room are in a through arrangement, which the casketing-room has an open bottom end and a closed top end to provide for mounting a heat-conducting unit; wherein the heat-conducting unit is set with a heat-conducting pad symmetrically along the wall surface of the casketing-room; and a heat-conducting aluminum-extruding-piece is filled and full in the range of the heat-conducting pad;

wherein the lamp-seat defines an accommodating-room with an opening facing upward, and a connector capable of connecting an external power supply is arranged at the bottom of the lamp-seat; wherein a driving circuit is installed on the inner side of the accommodating-room, and the driving circuit controls the input current from the connector to the circuit board; wherein a heat dissipation unit is further set between the lamp-seat and the heat-conducting unit; wherein the heat dissipation unit is formed by face-to-face combining two heat-sinking pieces for defining a base portion capable of inserting the accommodating-room, a first region capable of abutting the surface of the circuit board, and further set a second region that can abut the front and rear sides and the bottom end of the heat-conducting unit;

wherein the heat dissipation unit is further set with a ring protruding-flange capable of abutting the top end of the lamp-seat; and is set with a plurality of heat-exchanging blocks which is symmetrically protruded from the front and rear sides over the lamp-seat; wherein the bottom end of the lampshade is one-body fixed over the lamp-seat through the ring protruding-flange of the heat dissipation unit integrally, and the lampshade also has a plurality of notches provided for the heat-exchanging blocks to protrude and expose.

2. The LED bulb according to claim 1, wherein the front and rear sides of the upper-emitting light-source module, the oblique-upper emitting light-source module, and the oblique-lower emitting light-source module are aligned with each other, and the distance is maintained at a first size, and the distance from the right side to the right side of the light-source modules is further controlled to maintain a second size; and the distance from the right side to the right side of the light-source modules is further controlled to maintain a second size, and the distance from the top end to the bottom end is maintained at a third size.

3. The LED bulb according to claim 1, wherein the upper-emitting light-source module, the oblique-upper emitting light-source module, and the oblique-lower emitting light-source module each has an illumination angle of 120°; and further controlling the upper-emitting light-source module and the oblique-upper emitting light-source module to have an interlaced angle of not more than 30°; and controlling the oblique-upper emitting light-source module and the oblique-lower emitting light-source module to have an interlaced angle of not more than 30°.

4. The LED bulb according to claim 2, wherein the first size is maintained at 9 mm, the second size is maintained at 5 mm, and the third size is maintained at 7 mm.

5. The LED bulb according to claim 2, wherein the upper-emitting light-source module, the oblique-upper emitting light-source module, and the oblique-lower emitting light-source module each has an illumination angle of 120°; and further controlling the upper-emitting light-source module and the oblique-upper emitting light-source module to have an interlaced angle of not more than 30°; and controlling the oblique-upper emitting light-source module and the oblique-lower emitting light-source module to have an interlaced angle of not more than 30°.

6. The LED bulb according to claim 2, wherein the circuit board defines a casketing-room with an opening facing downward, and further defines that the front and rear directions of the casketing-room are in a through arrangement, which the casketing-room has an open bottom end and a closed top end to provide for mounting a heat-conducting unit; wherein the heat-conducting unit is set with a heat-conducting pad symmetrically along the wall surface of the casketing-room; and a heat-conducting aluminum-extruding-piece is filled and full in the range of the heat-conducting pad.

7. The LED bulb according to claim 4, wherein the upper-emitting light-source module, the oblique-upper emitting light-source module, and the oblique-lower emitting light-source module each has an illumination angle of 120°; and further controlling the upper-emitting light-source module and the oblique-upper emitting light-source module to have an interlaced angle of not more than 30°; and controlling the oblique-upper emitting light-source module and the oblique-lower emitting light-source module to have an interlaced angle of not more than 30°.

8. The LED bulb according to claim 4, wherein the circuit board defines a casketing-room with an opening facing downward, and further defines that the front and rear directions of the casketing-room are in a through arrangement, which the casketing-room has an open bottom end and a closed top end to provide for mounting a heat-conducting unit; wherein the heat-conducting unit is set with a heat-conducting pad symmetrically along the wall surface of the casketing-room; and a heat-conducting aluminum-extruding-piece is filled and full in the range of the heat-conducting pad.

9. The LED bulb according to claim 3, wherein the top end of the circuit board defines a first portion presenting a horizontal plane, such that the first portion, the second portion, and the third portion are symmetrically formed into five sides of the regular hexagon.

10. The LED bulb according to claim 5, wherein the top end of the circuit board defines a first portion presenting a horizontal plane, such that the first portion, the second portion, and the third portion are symmetrically formed into five sides of the regular hexagon.

11. The LED bulb according to claim 7, wherein the top end of the circuit board defines a first portion presenting a horizontal plane, such that the first portion, the second portion, and the third portion are symmetrically formed into five sides of the regular hexagon.

12. The LED bulb according to claim 6, wherein the lamp-seat defines a accommodating-room with an opening facing upward, and a connector capable of connecting an external power supply is arranged at the bottom of the lamp-seat; wherein a driving circuit is installed on the inner side of the accommodating-room, and the driving circuit controls the input current from the connector to the circuit board; wherein a heat dissipation unit is further set between the lamp-seat and the heat-conducting unit; wherein the heat dissipation unit is formed by face-to-face combining two heat-sinking pieces for defining a base portion capable of inserting the accommodating-room, a first region capable of abutting the surface of the circuit board, and further set a second region that can abut the front and rear sides and the bottom end of the heat-conducting unit.

13. The LED bulb according to claim 6, wherein the heat dissipation unit is further set with a ring protruding-flange capable of abutting the top end of the lamp-seat; and is set with a plurality of heat-exchanging blocks which is symmetrically protruded from the front and rear sides over the lamp-seat; wherein the bottom end of the lampshade is one-body fixed over the lamp-seat through the ring protruding-flange of the heat dissipation unit integrally, and the lampshade also has a plurality of notches provided for the heat-exchanging blocks to protrude and expose.

14. The LED bulb according to claim 8, wherein the lamp-seat defines a accommodating-room with an opening facing upward, and a connector capable of connecting an external power supply is arranged at the bottom of the lamp-seat; wherein a driving circuit is installed on the inner side of the accommodating-room, and the driving circuit controls the input current from the connector to the circuit board; wherein a heat dissipation unit is further set between the lamp-seat and the heat-conducting unit; wherein the heat dissipation unit is formed by face-to-face combining two heat-sinking pieces for defining a base portion capable of inserting the accommodating-room, a first region capable of abutting the surface of the circuit board, and further set a second region that can abut the front and rear sides and the bottom end of the heat-conducting unit.

15. The LED bulb according to claim 8, wherein the heat dissipation unit is further set with a ring protruding-flange capable of abutting the top end of the lamp-seat; and is set with a plurality of heat-exchanging blocks which is symmetrically protruded from the front and rear sides over the lamp-seat; wherein the bottom end of the lampshade is one-body fixed over the lamp-seat through the ring protruding-flange of the heat dissipation unit integrally, and the lampshade also has a plurality of notches provided for the heat-exchanging blocks to protrude and expose.

* * * * *